US009376974B2

(12) United States Patent
Kim

(10) Patent No.: US 9,376,974 B2
(45) Date of Patent: Jun. 28, 2016

(54) METHOD AND SYSTEM FOR CONTROLLING FUEL INJECTION FOR VEHICLES

(75) Inventor: Taek Soo Kim, Uiwang-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 916 days.

(21) Appl. No.: 13/192,242

(22) Filed: Jul. 27, 2011

(65) Prior Publication Data

US 2012/0143473 A1 Jun. 7, 2012

(30) Foreign Application Priority Data

Dec. 2, 2010 (KR) ..... 10-2010-0122236

(51) Int. Cl.

| | |
|---|---|
| ***F02D 41/12*** | (2006.01) |
| ***F02D 17/00*** | (2006.01) |
| ***F02D 41/02*** | (2006.01) |
| *F02D 41/18* | (2006.01) |

(52) U.S. Cl.

CPC ..... *F02D 41/123* (2013.01); *F02D 17/00* (2013.01); *F02D 41/021* (2013.01); *F02D 41/18* (2013.01); *F02D 2200/0404* (2013.01); *F02D 2200/101* (2013.01); *F02D 2200/501* (2013.01)

(58) Field of Classification Search

CPC . F02D 41/12; F02D 41/00005; F02D 41/107; F02D 41/045; F02D 41/3064; F02D 41/307

USPC ..... 123/325, 326, 493; 701/103, 104, 112

See application file for complete search history.

(56) References Cited

U.S. PATENT DOCUMENTS

| | | | | |
|---|---|---|---|---|
| 4,690,117 | A * | 9/1987 | Isobe et al. | 123/492 |
| 4,919,101 | A * | 4/1990 | Noguchi et al. | 123/493 |
| 4,987,876 | A * | 1/1991 | Minamitani et al. | 123/492 |
| 5,159,913 | A * | 11/1992 | Furuya | 123/493 |
| 6,978,204 | B2 * | 12/2005 | Surnilla et al. | 701/103 |

FOREIGN PATENT DOCUMENTS

| | | | |
|---|---|---|---|
| CN | 1727656 | A | 2/2006 |
| JP | 2004-316588 | A | 11/2004 |
| JP | 2006-152967 | A | 6/2006 |

* cited by examiner

*Primary Examiner* — Hieu T Vo
*Assistant Examiner* — Sherman Manley
(74) *Attorney, Agent, or Firm* — Morgan, Lewis & Bockius LLP

(57) ABSTRACT

A method and system for controlling fuel injection for vehicles controls fuel injection amount according to change in kinetic energy of the vehicle or performs fuel cut control so as to improve fuel economy. The method may include setting a first energy line corresponding to energy loss due to running resistance when deceleration, setting a second energy line corresponding to energy loss due to engine friction, determining whether kinetic energy of the vehicle is above the first energy line after a predetermined time has elapsed, and injecting fuel by an amount generating energy corresponding to a sum of engine friction energy and braking energy in a case that the kinetic energy of the vehicle is above the first energy line.

14 Claims, 5 Drawing Sheets

METHOD AND SYSTEM FOR CONTROLLING FUEL INJECTION FOR VEHICLES

CROSS-REFERENCE TO RELATED APPLICATION

This application claims priority to and the benefit of Korean Patent Application No. 10-2010-0122236 filed Dec. 2, 2010, the entire contents of which application is incorporated herein for all purposes by this reference.

BACKGROUND OF INVENTION

1. Field of Invention

The present invention relates to a method and a system for controlling fuel injection for vehicles. More particularly, the present invention relates to a method and a system for controlling fuel injection for vehicles which control fuel injection amount according to change in kinetic energy of the vehicle or performs fuel cut control so as to improve fuel economy.

2. Description of Related Art

Recently, exhaust regulations and fuel mileage regulations have been strengthened in each country in order to overcome global warming and oil resource depletion. In order to enhance fuel economy, it is required for driving components such as power trains to be improved in hardware aspect and fuel cut control and idle stop and go control have been developed in software aspect.

The fuel cut control is stop supplying fuel to an engine under fuel cut condition. That is, enhancement of fuel economy is promoted by making the vehicle run by inertial force.

According to a conventional fuel cut condition, only engine control aspect such as intake amount, throttle valve opening, engine speed, time for reentering, and so on is considered. Such fuel cut control may be preferable in some aspect such as engine and exhaust controls, but may deteriorate fuel economy at a special driving mode.

That is, since the fuel cut control is performed when predetermined fuel cut condition is satisfied regardless change in kinetic energy of the vehicle, fuel cut control may be performed at a region where fuel cut is unnecessary. At this time, more fuel may be used for restoring the kinetic energy of the vehicle reduced by the fuel cut.

FIG. 5 is a graph illustrating vehicle speed and integrated fuel amount at some cases.

In FIG. 5, a solid line is a graph illustrating change in the vehicle speed and the integrated fuel amount at case 1, a dotted line is a graph illustrating the change in the vehicle speed and the integrated fuel amount at case 2, and a one-point chain line is a graph illustrating the change in the vehicle speed and the integrated fuel amount at case 3.

In addition, the case 1 is a case where an engine and a driving system are not connected and the engine is maintained at an idle state, the case 2 is a case where the vehicle is naturally decelerated without the fuel cut in a state that the engine and the driving system are connected, and the case 3 is a case where the fuel cut is performed in a state that the engine and the driving system are connected.

As shown in FIG. 4, fuel amount for running the same distance is as follows.

case 1<case 2<case 3

That is, actual fuel economy may be further improved when the fuel cut is not performed, rather than when the fuel cut is performed in a state that the driving system is connected.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a method and a system for controlling fuel injection for vehicles having advantages of improving fuel economy as a consequence of calculating optimal fuel injection amount considering of change in kinetic energy of the vehicle.

A method for controlling fuel injection for vehicles according to various aspects of the present invention may include setting a first energy line corresponding to energy loss due to running resistance when deceleration, setting a second energy line corresponding to energy loss due to engine friction, determining whether kinetic energy of the vehicle is above the first energy line after a predetermined time has elapsed, and injecting fuel by an amount generating energy corresponding to a sum of engine friction energy and braking energy in a case that the kinetic energy of the vehicle is above the first energy line.

In a case that the kinetic energy of the vehicle is on the first energy line, the method may further include injection of the fuel by an amount generating energy corresponding to the engine friction energy.

In a case that the kinetic energy of the vehicle is between the first energy line and the second energy line, the method may further include injection of the fuel by an amount generating energy smaller than the engine friction energy.

In a case that kinetic energy of the vehicle is on or under the second energy line, the method may further include determining whether fuel cut condition is satisfied, and performing fuel cut control in a case that the fuel cut condition is satisfied.

The fuel cut condition may be satisfied when intake amount is smaller than predetermined intake amount, throttle opening is smaller than predetermined throttle opening, engine speed is faster than predetermined engine speed, and time for reentering fuel cut mode is longer than predetermined time.

A system for controlling fuel injection for vehicles according to other aspects of the present invention may include a control portion generating a control signal for controlling fuel injection according to a driving condition of the vehicle, and an injector for injecting fuel by the control signal of the control portion, wherein the control portion sets a first energy line corresponding to energy loss due to running resistance when deceleration and a second energy line corresponding to energy loss due to engine friction, and generates the control signal by comparing kinetic energy of the vehicle with the first and second energy lines after a predetermined time has elapsed.

The control portion may generate the control signal for injecting fuel by an amount generating energy corresponding to engine friction energy in a case that the kinetic energy of the vehicle is above the first energy line.

The control portion may generate the control signal for injecting the fuel by an amount generating energy smaller than the engine friction energy in a case that the kinetic energy of the vehicle is between the first energy line and the second energy line.

The control portion may determine whether fuel cut condition is satisfied in a case that the kinetic energy of the vehicle is on or under the second energy line, and may perform fuel cut control in a case that the fuel cut condition is satisfied.

The fuel cut condition may be satisfied when intake amount is smaller than predetermined intake amount, throttle opening is smaller than predetermined throttle opening, engine speed is faster than predetermined engine speed, and time for reentering fuel cut mode is longer than predetermined time.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
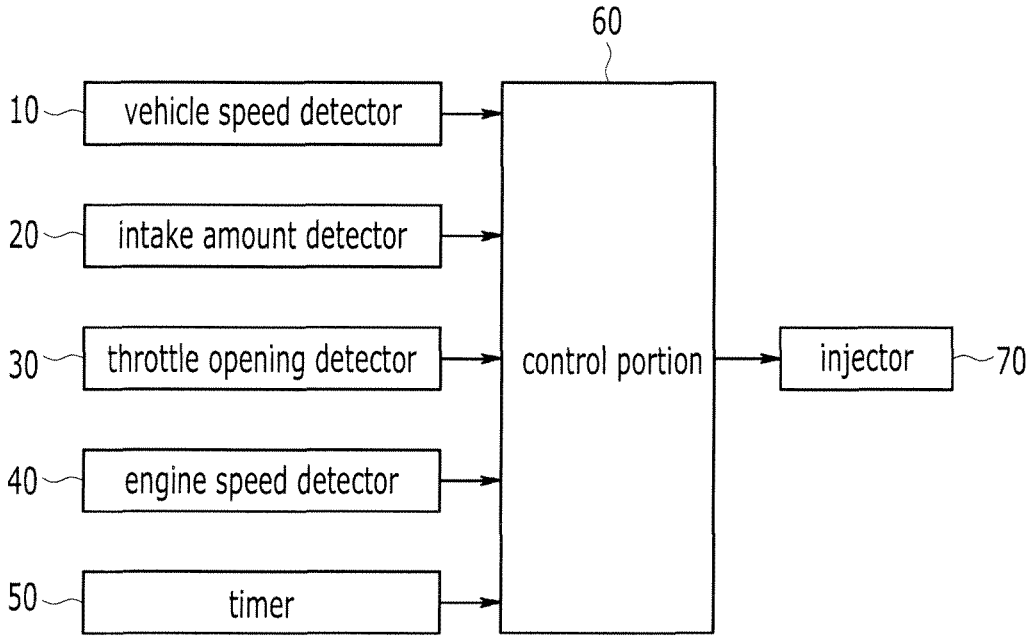
FIG. 1 is a block diagram of an exemplary system for controlling fuel injection for vehicles according to the present invention.

As shown in FIG. 1, a system for controlling fuel injection for vehicles according to an exemplary embodiment of the present invention includes a vehicle speed detector 10, an intake amount detector 20, a throttle opening detector 30, an engine speed detector 40, a timer 50, a control portion 60, and an injector 70.

The vehicle speed detector 10 may be mounted at a wheel of the vehicle. The vehicle speed detector 10 detects vehicle speed and delivers a signal corresponding thereto to the control portion 60.

The intake amount detector 20 is mounted at an intake passage, detects intake air amount, and delivers a signal corresponding thereto to the control portion 60.

The throttle opening detector 30 is mounted at the intake passage of the vehicle, detects opening of a throttle valve operated according to operation degree of an accelerator pedal, and delivers a signal corresponding thereto to the control portion 60. An accelerator pedal position sensor may be used instead of using the throttle opening detector 30, and it is to be understood in this specification and claim set that the throttle opening detector includes the accelerator pedal position sensor.

The engine speed detector 40 is mounted at a crankshaft, detects rotation speed of an engine from change in phase of the crankshaft, and delivers a signal corresponding thereto to the control portion 60.

The timer 50 detects elapsed time from a point when a specific event occurs and delivers a signal corresponding thereto to the control portion 60. For example, the specific event may be release of fuel cut control or occurrence of deceleration.

Meanwhile, a plurality of sensors may be included in the system for controlling fuel injection for vehicles according to an exemplary embodiment of the present invention except the sensors (detectors) shown in FIG. 1, but a detailed description thereof will be omitted for better comprehension and ease of description.

The control portion 60 decides a driving condition of the vehicle based on the values detected by the detectors 10, 20, 30, and 40 and the timer 50 and generates control signal for injecting fuel according to the driving condition of the vehicle. Operation of the control portion 60 will be described in further detail.

The injector 70 receives the control signal from the control portion 60 and injects the fuel according to the control signal.

Hereinafter, a method for controlling fuel injection for vehicles according to an exemplary embodiment of the present invention will be described with reference to FIG. 2 and FIG. 3.

Figure 2:
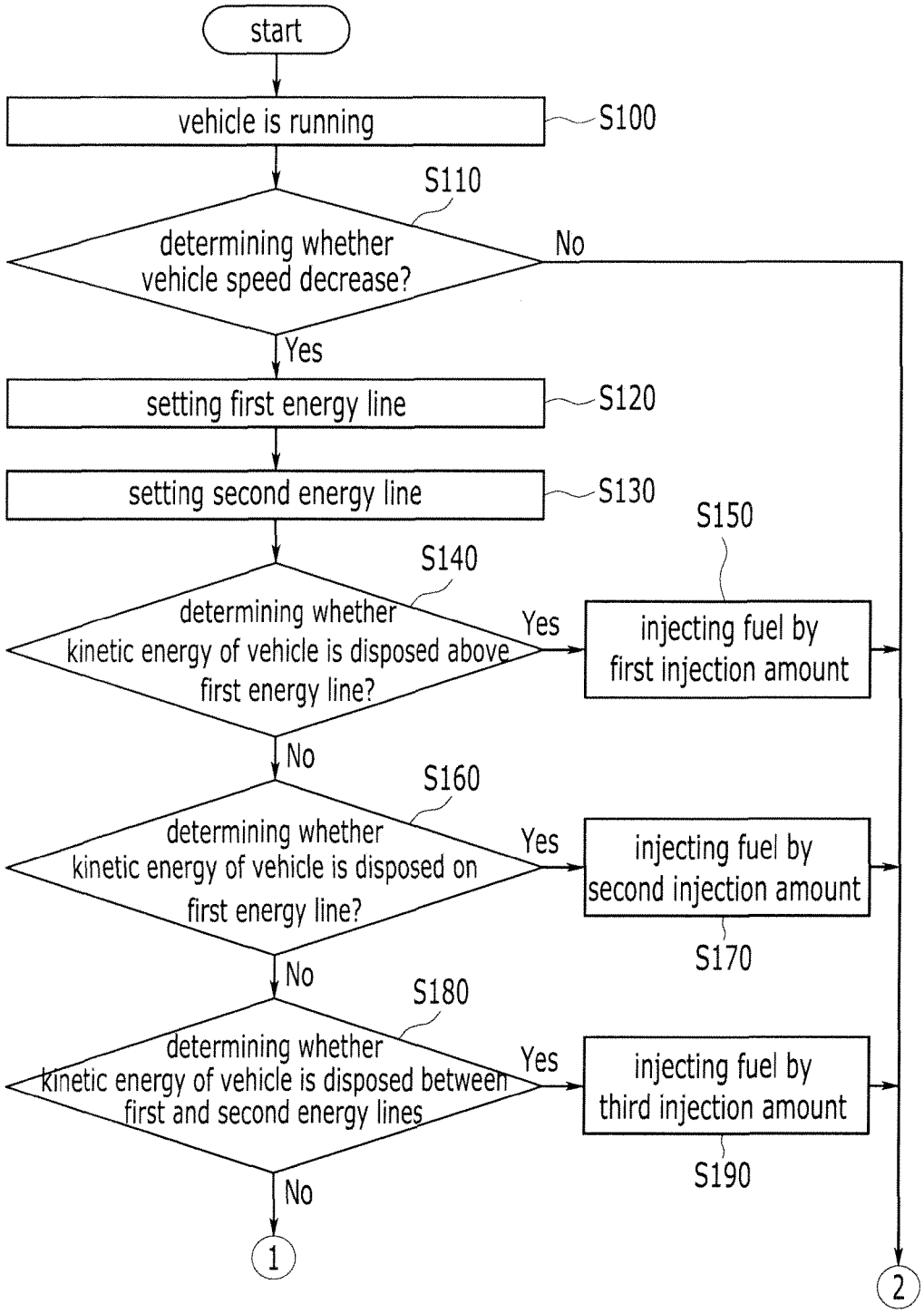
FIG. 2 and FIG. 3 are flowcharts of an exemplary method for controlling fuel injection for vehicles according to the present invention.

As shown in FIG. 2, a method for controlling fuel injection for vehicles according to an exemplary embodiment of the present invention begins in a state that the vehicle runs at a step S100.

In a state that the vehicle runs, the control portion 60 determines whether the vehicle speed decreases at a step S110.

If the vehicle speed does not decrease at the step S110, the control portion 60 finishes an exemplary embodiment of the present invention and enters a predetermined control mode according to a current driving condition of the vehicle.

If the vehicle speed decreases at the step S110, the control portion 50 sets a first energy line (coast down line) corresponding to energy loss due to running resistance at a step S120, and sets a second energy line (engine friction line) corresponding to energy loss due to engine friction at a step S130. The first energy line and the second energy line according to the driving condition of the vehicle such as vehicle speed may be predetermined at the control portion 60 by designers.

Generally, driving mode of the vehicle is divided into four modes shown in Table 1:

| mode | vehicle speed | acceleration | engine output | note |
|---|---|---|---|---|
| I | >0 | ≥0 | >0 | acceleration, constant speed |
| II | >0 | <0 | >0 | deceleration (powered) |
| III | >0 | <0 | ≥0 | braking |
| IV | =0 | =0 | ≥0 | stop (idle) |

An acceleration region or a constant speed region of mode is a case where the vehicle overcomes the running resistance energy and maintains constant vehicle speed or increases the vehicle speed by supplying more fuel.

A powered deceleration region of mode II is disposed between a constant speed line and a coast down line, and is a case where fuel is supplied in order to overcome a part of the running resistance and the vehicle speed decreases continuously.

A braking region of mode III is disposed under the coast down line and is a case the vehicle decreases. The braking region includes engine brake deceleration where the vehicle speed decreases by an amount corresponding to engine friction energy and braking deceleration where the vehicle speed more decreases than the amount, that is a foot brake is used so as to convert the kinetic energy of the vehicle into heat energy. The mode III is divided into two modes shown in Table 2:

| mode | speed | acceleration | output | note |
|---|---|---|---|---|
| III-I | >0 | <0 | >0 | between coast down line and engine friction line |
| III-II | >0 | <0 | =0 | under engine friction line |

Figure 4:
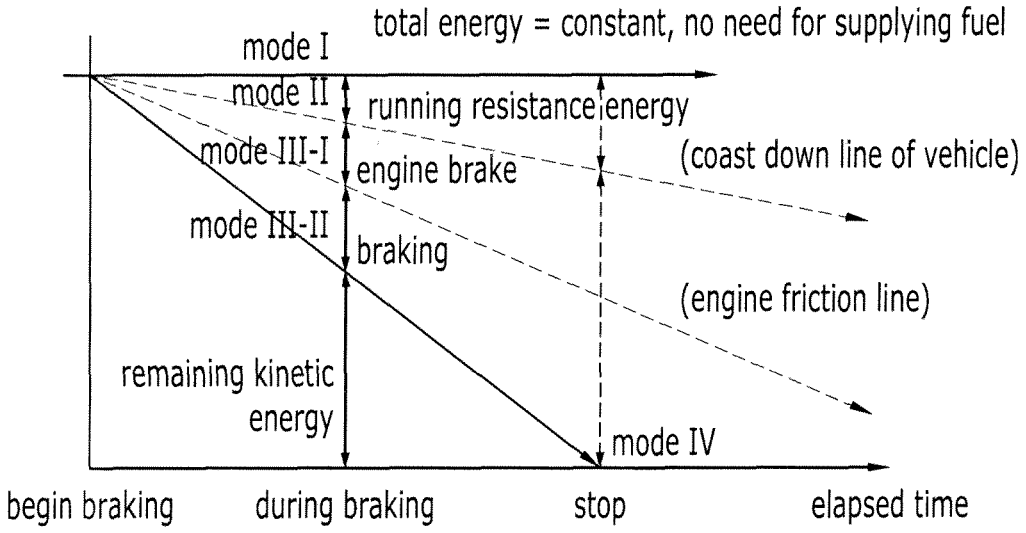
FIG. 4 is a drawing illustrating driving regions for performing an exemplary method for controlling fuel injection for vehicles according to the present invention.
Figure 5:
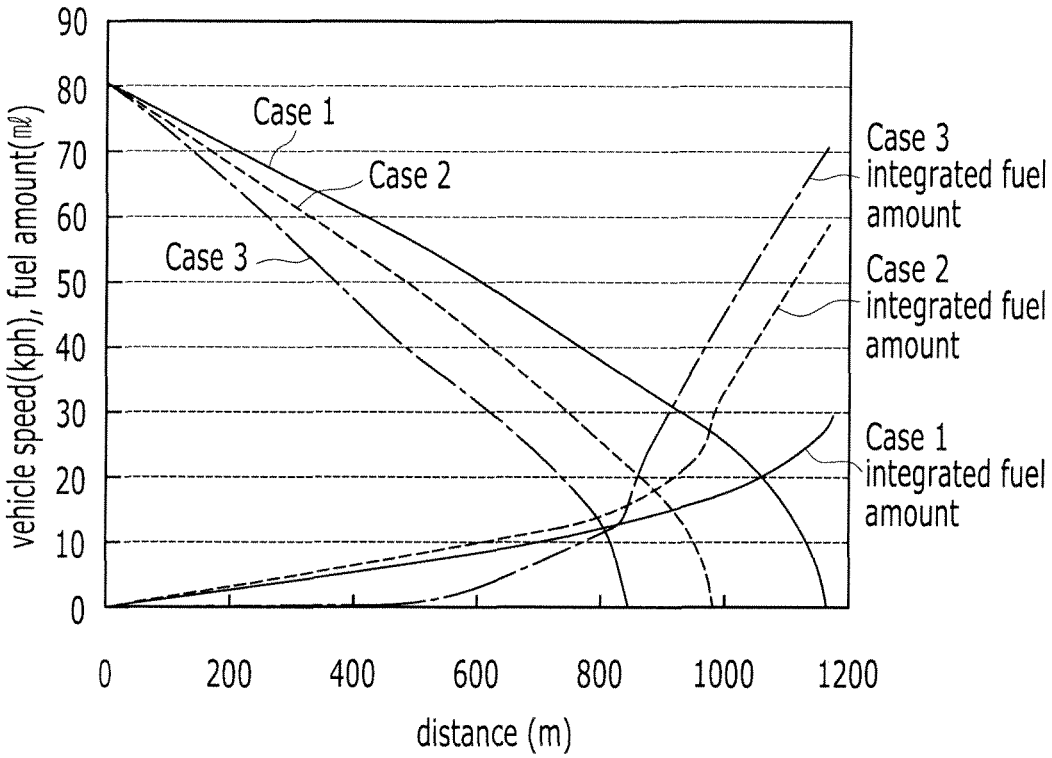
FIG. 5 is a graph illustrating vehicle speed and integrated fuel amount at some cases.

The driving modes of the vehicle as mentioned above are illustrated in FIG. 4. The steps S120 and S130 are to set the coast down line and the engine friction line in FIG. 4.

If the first and second energy lines are set, the control portion 60 compares the kinetic energy of the vehicle with the first and second energy lines after predetermined time has elapsed.

That is, the control portion 60 determines whether the kinetic energy of the vehicle is disposed above the first energy line at a step S140.

If the kinetic energy of the vehicle is disposed above the first energy line (i.e., vehicle is decelerating at the mode II) at the step S140, the vehicle must overcome the total engine friction energy and the braking energy and run. Therefore, the control portion 60 controls the injector 70 to inject the fuel by a first injection amount at a step S150. The first injection amount is represented in Equation 1.

$$m = \frac{W_{TOTAL\ FRICTION}}{\eta_i \times Q_{LHV}} + \frac{W_{BRAKE}}{\eta_i \times Q_{LHV}} \quad \text{Equation 1}$$

Herein, m denotes fuel injection amount, $W_{TOTAL\ FRICTION}$ denotes the total engine friction energy, $W_{BRAKE}$ denotes the braking energy, $\eta_i$ denotes an indicated efficiency, and $Q_{LHV}$ denotes a low-heating value of the fuel.

If the kinetic energy of the vehicle is not disposed above the first energy line at the step S140, the control portion 60 determines whether the kinetic energy of the vehicle is disposed on the first energy line at a step S160.

If the kinetic energy of the vehicle is disposed on the first energy line at the step S160, the vehicle must overcome the total engine friction energy and run. Therefore, the control portion 60 controls the injector 70 to inject the fuel by a second injection amount at a step S170. The second injection amount is represented in Equation 2.

$$m = \frac{W_{TOTAL\ FRICTION}}{\eta_i \times Q_{LHV}} \quad \text{Equation 2}$$

If the kinetic energy of the vehicle is not disposed on the first energy line at the step S160, the control portion 60 determines whether the kinetic energy of the vehicle is disposed between the first and second energy lines at a step S180.

If the kinetic energy of the vehicle is disposed between the first and second energy lines at the step S180, the control portion 60 controls the injector 70 to inject the fuel by a third injection amount at a step S190. The third injection amount is represented in Equation 3.

$$m = \alpha \cdot \frac{W_{TOTAL\ FRICTION}}{\eta_i \times Q_{LHV}} \quad \text{Equation 3}$$

Herein, α denotes a deceleration coefficient and is a value between 0 and 1. The deceleration coefficient is calculated according to change in the kinetic energy of the vehicle.

If the kinetic energy of the vehicle is not disposed between the first and second energy lines at the step S180, the control portion 60 determines whether the fuel cut condition is satisfied.

Figure 3:
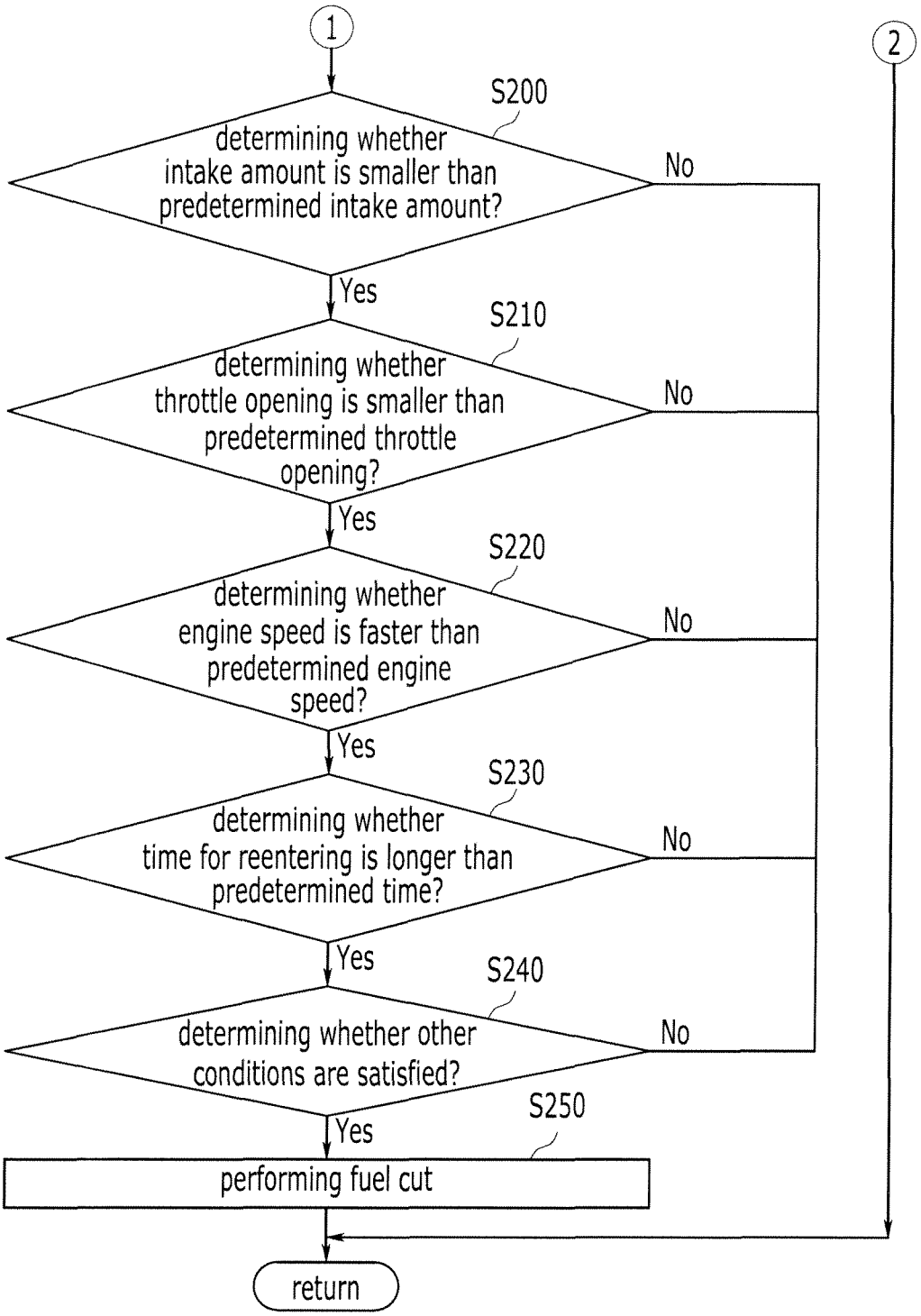

That is, as shown in FIG. 3, the control portion 60 determines whether the intake amount is smaller than predetermined intake amount at a step S200, whether the throttle opening is smaller than predetermined throttle opening at a step S210, whether the engine speed is faster than predetermined engine speed at a step S220, whether time for reentering is longer than predetermined time at a step S230, and whether other conditions are satisfied at a step S240.

Herein, the time for reentering means time elapsed from previous fuel cut to a current time. In addition, other conditions include whether the brake pedal is operated.

If all the conditions of the steps S200, S210, S220, S230, and S240 are satisfied, the control portion 60 performs fuel cut at a step S250. The fuel cut control is well known to a person of an ordinary skill in the art, and thus detailed description thereof will be omitted.

Since fuel injection is controlled at a region where fuel cut was performed according to a conventional method but is unnecessary, fuel economy may be improved according to an exemplary embodiment of the present invention.

In an exemplary embodiment of the present invention, a driving region at which vehicle speed decreases is subdivided considering of energy management, and optimal fuel injection is performed at each driving region. Therefore, fuel economy may be improved.

In addition, since unnecessary fuel cut control is prevented from being performed, fuel economy may further improved.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method for controlling fuel injection for vehicles, comprising:

setting a first energy line corresponding to energy loss due to running resistance when deceleration;

setting a second energy line corresponding to energy loss due to engine friction;

determining whether kinetic energy of the vehicle is above the first energy line after a predetermined time has elapsed; and injecting fuel by an amount generating energy corresponding to a sum of engine friction energy and braking energy in a case that the kinetic energy of the vehicle is above the first energy line, wherein when the kinetic energy of the vehicle is disposed above the first energy line, a first injection amount is determined by $$m = \frac{W_{TOTAL\,FRICTION}}{\eta_i \times Q_{LHV}} + \frac{W_{BRAKE}}{\eta_i \times Q_{LHV}},$$

wherein m denotes fuel injection amount, $W_{TOTAL\ FRICTION}$ denotes total engine friction energy, $W_{BRAKE}$ denotes braking energy, $\eta_i$ denotes an indicated efficiency, and $Q_{LHV}$ denotes a low-heating value of the fuel.

2. The method of claim 1, further comprising injection of the fuel by an amount generating energy corresponding to the engine friction energy in a case that the kinetic energy of the vehicle is on the first energy line.

3. The method of claim 1, further comprising injection of the fuel by an amount generating energy smaller than the engine friction energy in a case that the kinetic energy of the vehicle is between the first energy line and the second energy line.

4. The method of claim 1, in a case that kinetic energy of the vehicle is on or under the second energy line, further comprising:

determining whether fuel cut condition is satisfied; and performing fuel cut control in a case that the fuel cut condition is satisfied.

5. The method of claim 4, wherein when the kinetic energy of the vehicle is disposed on the first energy line, a second injection amount is determined by $$m = \frac{W_{TOTAL\,FRICTION}}{\eta_i \times Q_{LHV}},$$

wherein m denotes fuel injection amount, $W_{TOTAL\ FRICTION}$ denotes total engine friction energy, $\eta_i$ denotes an indicated efficiency, and $Q_{LHV}$ denotes a low-heating value of the fuel.

6. The method of claim 4, wherein when the kinetic energy of the vehicle is disposed between the first and second energy lines, the third injection amount is determined by $$m = \alpha \cdot \frac{W_{TOTAL\,FRICTION}}{\eta_i \times Q_{LHV}},$$

wherein m denotes fuel injection amount, $W_{TOTAL\ FRICTION}$ denotes the total engine friction energy, $\eta_i$ denotes an indicated efficiency, $Q_{LHV}$ denotes a low-hating value of the fuel, and $\alpha$ denotes a deceleration coefficient and is a value between 0 and 1.

7. The method of claim 4, wherein the fuel cut condition is satisfied when intake amount is smaller than predetermined intake amount, throttle opening is smaller than predetermined throttle opening, engine speed is faster than predetermined engine speed, and time for reentering fuel cut mode is longer than predetermined time.

8. A system for controlling fuel injection for vehicles, comprising:

a control portion generating a control signal for controlling fuel injection according to a driving condition of the vehicle; and an injector for injecting fuel by the control signal of the control portion;

wherein the control portion sets a first energy line corresponding to energy loss due to running resistance when deceleration and a second energy line corresponding to energy loss due to engine friction, and generates the control signal by comparing kinetic energy of the vehicle with the first and second energy lines after a predetermined time has elapsed, wherein when the kinetic energy of the vehicle is disposed above the first energy line, a first injection amount is determined by $$m = \frac{W_{TOTAL\,FRICTION}}{\eta_i \times Q_{LHV}} + \frac{W_{BRAKE}}{\eta_i \times Q_{LHV}},$$

wherein m denotes fuel injection amount, $W_{TOTAL\ FRICTION}$ denotes total engine friction energy, $W_{BRAKE}$ denotes braking energy, $\eta_i$ denotes an indicated efficiency, and $Q_{LHV}$ denotes a low-heating value of the fuel.

9. The system of claim 8, wherein the control portion generates the control signal for injecting fuel by an amount generating energy corresponding to engine friction energy in a case that the kinetic energy of the vehicle is above the first energy line.

10. The system of claim 8, wherein the control portion generates the control signal for injecting the fuel by an amount generating energy smaller than the engine friction energy in a case that the kinetic energy of the vehicle is between the first energy line and the second energy line.

11. The system of claim 8, wherein the control portion determines whether fuel cut condition is satisfied in a case that the kinetic energy of the vehicle is on or under the second energy line, and performs fuel cut control in a case that the fuel cut condition is satisfied.

12. The system of claim 11, wherein the fuel cut condition is satisfied when intake amount is smaller than predetermined intake amount, throttle opening is smaller than predetermined throttle opening, engine speed is faster than predetermined engine speed, and time for reentering fuel cut mode is longer than predetermined time.

13. The system of claim 8, wherein when the kinetic energy of the vehicle is disposed on the first energy line, a second injection amount is determined by $$m = \frac{W_{TOTAL\,FRICTION}}{\eta_i \times Q_{LHV}},$$

wherein m denotes fuel injection amount, $W_{TOTAL\ FRICTION}$ denotes total engine friction energy, $\eta_i$ denotes an indicated efficiency, and $Q_{LHV}$ denotes a low-heating value of the fuel.

14. The system of claim 8, wherein when the kinetic energy of the vehicle is disposed between the first and second energy lines, a third injection amount is determined by $$m = \alpha \cdot \frac{W_{TOTAL\,FRICTION}}{\eta_i \times Q_{LHV}},$$

wherein m denotes fuel injection amount, $W_{TOTAL\ FRICTION}$ denotes total engine friction energy, $\eta_i$ denotes an indicated efficiency, $Q_{LHV}$ denotes a low-heating value of the fuel, and $\alpha$ denotes a deceleration coefficient and is a value between 0 and 1.

* * * * *